United States Patent [19]

Lundgren

[11] Patent Number: 4,936,050

[45] Date of Patent: Jun. 26, 1990

[54] MOBILE DESK APPARATUS

[76] Inventor: Peter K. Lundgren, 17 Redbud La., Hurlburt Field, Fla. 32544

[21] Appl. No.: 383,598

[22] Filed: Jul. 24, 1989

[51] Int. Cl.[5] ..... A47B 91/00

[52] U.S. Cl. ..... 312/250; 312/254; 312/315; 248/156

[58] Field of Search ..... 49/315, 316, 327, 328, 49/329, 254, 250; 248/156, 444.1; 108/157, 44

[56] References Cited

U.S. PATENT DOCUMENTS

| | | | |
|---|---|---|---|
| 909,796 | 1/1909 | Hetterschied | 312/315 |
| 1,325,164 | 12/1919 | Mowrey | 108/157 |
| 2,409,925 | 10/1946 | Bloom | 312/315 |
| 2,983,367 | 5/1961 | Paramater | 312/328 |
| 3,087,767 | 4/1963 | Schell | 312/250 |
| 3,148,923 | 9/1964 | Smith | 312/316 |
| 3,244,163 | 4/1966 | McGlaughlin | 312/315 |
| 3,345,118 | 10/1967 | Cummings | 108/44 |
| 3,368,858 | 2/1968 | Motter et al. | 312/254 |
| 3,459,327 | 8/1969 | Harris | 312/DIG. 33 |
| 3,612,454 | 10/1969 | Linn | 248/156 |

*Primary Examiner*—Peter R. Brown
*Assistant Examiner*—Gerald Anderson
*Attorney, Agent, or Firm*—Leon Gilden

[57] ABSTRACT

A mobile desk apparatus is set forth for use in inclement environmental conditions including horizontal legs spaced at one hundred twenty degrees relative to one another integrally and orthogonally secured to a central telescoping mass structure. An internal tube of the mast structure is fixedly mounted relative to an external tube by use of a friction lock directed through the external tube to impose upon an exterior surface of the internal tube. The desk portion includes a plurality of spaced "L" shaped brackets positioned on either side of the internal tube with arcuate slots directed therethrough to enable angular orientation of the desk relative to the mast structure. A transparent, polymeric cover is pivotally mounted to overlie the desk structure with a rear flange hingedly mounted adjacent a rear bottom edge of the desk and removably relative to the desk to present a selective writing surface or its removal enabling convenient access to interior contents of the desk.

8 Claims, 1 Drawing Sheet

MOBILE DESK APPARATUS

BACKGROUND OF THE INVENTION

1. Field of the Invention

The field of invention relates to desks, and more particularly pertains to a new and improved mobile desk apparatus wherein the same is arranged for continuous use in external and inclement weather conditions.

2. Description of the Prior Art

The use of desks of various organizations is well known in the prior art. Heretofore, however, desks have been conventionally configured and arranged for positioning interiorly of dwellings not subject to inclement weather conditions, wherein its use by individuals in such environmental conditions has developed a need for desks of construction to withstand positioning in environments subject to rain and the like. Examples of the prior devices include reference to U.S. Pat. No. 4,401,036 to Russo wherein a table-like arrangement is provided for use with beds with a castored "U" shaped bottom framework with a rearwardly positioned post and a table surface formed to a top portion of the post pivotally mounted thereto for overlying positioning to a bed structure.

U.S. Pat. No. 4,488,497 to Bevans provides a tool tray and desk organization with a framework formed with castors for its rolling positioning relative to a surface with a medial positioned rear post telescopingly mounted with a top tray support table surface.

U.S. Pat. No. 4,566,661 to Mestler sets forth a trio of legs pivotally mounted to a central mast structure with a table top orthogonally and axially mounted to the master organization.

U.S. Pat. No. 4,541,343 to Erard provides for a support structure formed with a series of legs mounted to a central post with a table organization fixedly mounted to the post.

U.S. Pat. No. 4,653,710 to Dickison sets forth a trolley organization utilizing a series of legs mounted about a central post utilizing castors at external portions of each leg.

As such, it may be appreciated that there is a continuing need for a new and improved mobile desk apparatus wherein the same addresses both the problems of ease of use and effectiveness in organization, and in this respect, the present invention substantially fulfills this need.

SUMMARY OF THE INVENTION

In view of the foregoing disadvantages inherent in the known types of desk apparatus now present in the prior art, the present invention provides a mobile desk apparatus wherein the same utilizes a convenient transparent covering overlying a receptacle of the desk for visual access to storage material therein with a table top mounted for rotation relative to a support mast to accommodate various users thereof. As such, the general purpose of the present invention, which will be described subsequently in greater detail, is to provide a new and improved mobile desk apparatus which has all the advantages of the prior art desk apparatus and none of the disadvantages.

To attain this, the present invention includes a mobile desk apparatus utilizing a trio of legs oriented at one hundred twenty degrees relative to one another mounted to a central mast wherein the mast is provided with a drainage hole through a bottom surface thereof with an internal tube telescopingly mounted within the mast. The inner tube is mounted relative to a desk structure utilizing a plurality of diametrically opposed "L" brackets to frictionally engage the inner tube, wherein each "L" bracket includes an arcuate slot to accommodate angulation of the desk relative to the tube. A transparent, polymeric cover is pivotally mounted overlying the desk to enable visual access to interior portions of the desk to minimize opening of the cover relative to the desk preventing wind, dust, moisture and the like from entering internal portions of the desk structure. The transparent cover is removable relative to the desk for ease of use of the desk as a storage facility.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mobile desk apparatus which has all the advantages of the prior art desk apparatus and none of the disadvantages.

It is another object of the present invention to provide a new and improved mobile desk apparatus which may be easily and efficiently manufactured and marketed.

It is a further object of the present invention to provide a new and improved mobile desk apparatus which is of a durable and reliable construction.

An even further object of the present invention is to provide a new and improved mobile desk apparatus which is susceptible of a low cost of manufacture with regard to both materials and labor, and which accordingly is then susceptible of low prices of sale to the consuming public, thereby making such mobile desk apparatus economically available to the buying public.

Still yet another object of the present invention is to provide a new and improved mobile desk apparatus which provides in the apparatuses and methods of the prior art some of the advantages thereof, while simultaneously overcoming some of the disadvantages normally associated therewith.

Still another object of the present invention is to provide a new and improved mobile desk apparatus wherein the same utilizes a pivotally mounted desk structure relative to a central support post to accommodate various positions of a user thereof with a transparent cover to permit visual observation of contents stored within the desk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
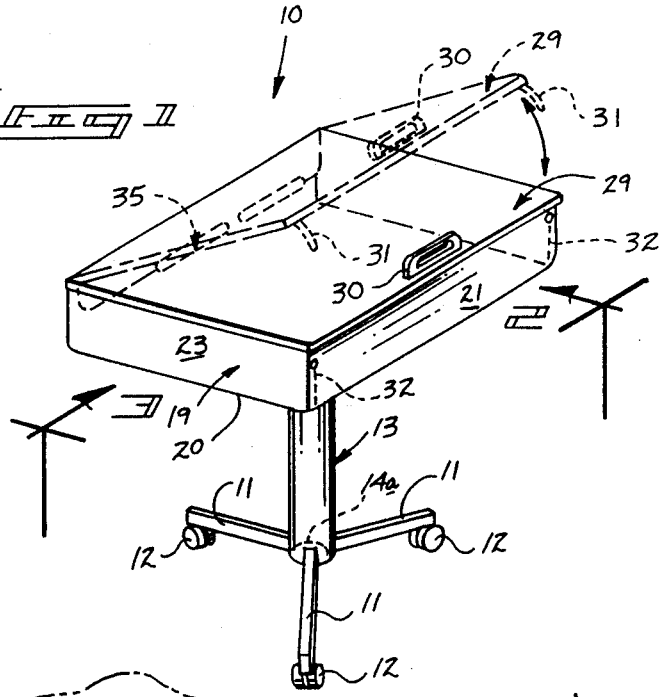
FIG. 1 is an isometric illustration of the instant invention.
Figure 2:
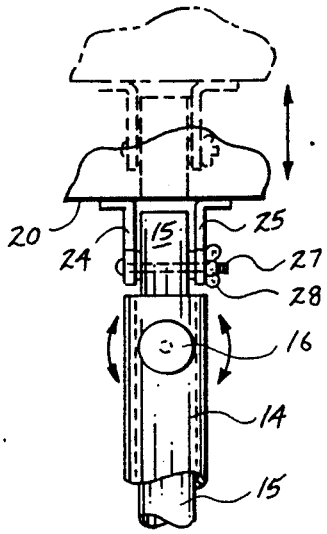
FIG. 2 is an orthographic view taken in elevation of the mast structure and its securement to the desk portion of the instant invention.
Figure 3:
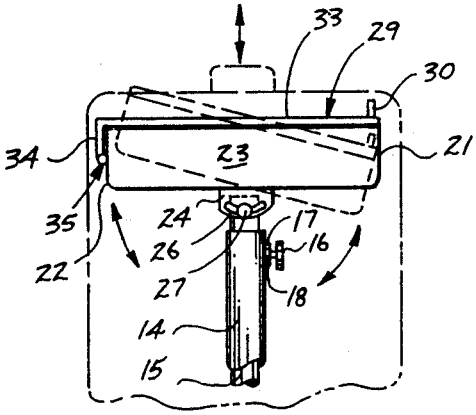
FIG. 3 is an orthographic view taken in elevation of the instant invention illustrating pivoting of the desk structure relative to the central support mast structure.

With reference now to the drawings, and in particular to FIGS. 1 to 4 thereof, a new and improved mobile desk apparatus embodying the principles and concepts of the present invention and generally designated by the reference numeral 10 will be described.

More specifically, the mobile desk apparatus 10 essentially comprises a series of three legs 11 formed of weather resistant materials, such as stainless steel, arranged orthogonally relative to a cylindrical mast assembly 13. The legs 11 includes industrial type roller castors 12 secured adjacent bottom terminal ends of the legs 11. Such rollers may be found in U.S. Pat. No. 4,653,710 incorporated herein by reference.

The mast assembly 13 includes a vertical outer tube 14 integrally secured to the legs 11 with an inner tube 15 telescopingly mounted interiorly of the outer tube 14. The inner and outer tubes may also be formed of a stainless steel material, wherein the outer tube is in a range of 20 to 22 inches high with the inner tube arranged from 22 to 26 inches high. The inner tube includes an upper terminal end spaced above the outer tube 14. The outer tube 14 further includes a central drainage opening 14*a* formed through a bottom wall of the outer tube 14 to permit moisture and the like to drain therethrough. The inner tube 15 is fixedly mounted in a telescoping relationship to the outer tube 14 utilizing a friction lock wheel 16 with a threaded shank 18 threadedly mounted through a wall of the outer tube 14 utilizing an internally threaded nut member 17 fixedly secured, such as by welding and the like to an exterior surface of the outer tube 14 to maintain the threaded shank 18 to be orthogonally disposed to an axis of both the outer and inner tubes. Accordingly, a remote terminal end of the threaded shank 18 will frictionally impose upon an exterior surface of the inner tube 15 upon appropriate rotation of the lock wheel 16 and conversely may be withdrawn from contact from an exterior surface of the inner tube 15 to permit telescoping of the inner tube 15 to a desired height relative to the outer tube 14.

The inner tube 15 is fixedly mounted relative to a floor 20 of the desk container 19, and wherein the inner tube 15 is axially aligned relative to a center of the floor 20 and mounted thereto utilizing a plurality of "L" shaped brackets, including a rear "L" shaped bracket 24 and forward "L" shaped bracket 25 diametrically positioned on opposed sides of an upper terminal end of the inner tube 15. The "L" shaped brackets include aligned arcuate slots 26 with a threaded fastener 27 formed with an elongate threaded shank and enlarged head to secure the fastener 27 relative to the rear bracket 24 with a wing nut 28 to frictionally engage an exterior surface of the forward "L" bracket 25 and thereby squeeze the inner tube 15 therebetween and maintain the desk container 29 in a predetermined angulation relative to the mast assembly 13, as desired. The desk container 29 includes a floor 20 with a forward wall 21 parallel to a rear wall 22 with spaced side walls 23, with each of the walls 21, 22, and 23 orthogonally arranged relative to the floor 20 to define the desk container 19. A transparent, polymeric cover 29 is formed with a top planar portion 33 and a rear portion 34 arranged orthogonally relative to a rear edge of the top planar portion 33 and of a height substantially equal to that of the rear wall 22 of the desk container 19. The transparent, polymeric cover 29 includes a handle 30 formed adjacent a forward distal edge thereof, wherein the top planar portion 33 includes an alignment peg 31 positioned at each forward corner of the cover top portion 33. The alignment pegs 31 are arranged for reception with alignment tubes 32 positioned at intersections of each of the side walls 23 with the forward wall 21. The alignment tubes 32 are of a height substantially equal to that of the forward and side walls and include an internal diameter substantially equal to that of the external diameter of the alignment pegs 31 to maintain the cover 29 in a secured relationship to the desk container 19 when in a closed orientation relative to the desk container. The rear portion 34 includes an elongate hinge 35 that is mounted medially the rear wall 22 along the height of and to a lowermost edge of the rear portion 34. Opening of the transparent cover 29 prevents impact of the cover with a support surface upon which the desk assembly 10 may be mounted and thereby avoid undue breakage and marring of the cover 29.

Figure 4:
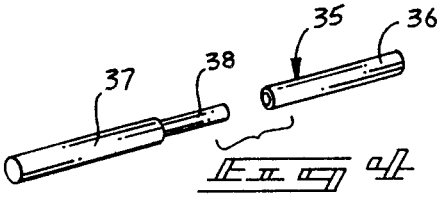
FIG. 4 is an isometric illustration of the hinge organization utilized by the instant invention.

The hinge 35, as illustrated in FIG. 4, permits removal of the transparent cover 29 relative to the desk container 19. The removal of the cover 29 permits convenient access to interior portions of the desk container 19, as well as its reassembly relative to the desk container 19 permitting its upper surface to be utilized to the desk, as desired. The hinge 35 includes a main tubular body 36 affixed medially of the rear wall 22 with a secondary tubular body 37 affixed to a bottom edge of the rear portion 34, wherein the secondary tubular body 37 includes an axially extending alignment rod 38 of a length substantially equal to that of the main tubular body 36 for insertion of the rod 38 within the hollow tubular body 36. The sliding relationship of the rod 38 relative to the main tubular body 36 permits removal and resecurement of the cover 29 relative to the desk container.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mobile desk apparatus comprising, in combination, a plurality of elongate leg members orthogonally affixed and disposed about a central mast assembly, each leg member including a rotatable castor mounted orthogonally relative to a bottom surface of each leg member adjacent a terminal outer end of each leg member, and the mast assembly including a desk container mounted thereon, the desk container including a floor, a forward wall, a rear wall, and spaced side walls, wherein each of the walls are in equal predetermined height, and a lid member mounted to the rear wall medially of an outer surface of the rear wall, and the lid member overlying the rear, forward, and side walls when in a first closed position, and wherein the lid member is horizontally disposed and remote from the rear, forward, and side walls when in a second open position.

2. A mobile desk apparatus as set forth in claim 1 wherein the lid member is transparent and formed of a polymeric material.

3. A mobile desk apparatus as set forth in claim 2 wherein the lid member includes a top planar portion, and a rear portion orthogonally affixed to a rear edge of the top planar portion and wherein the rear portion is of a height substantially half of the predetermined height of the walls.

4. A mobile desk apparatus as set forth in claim 3 wherein the rear portion of the lid member includes an elongate hinge, wherein the elongate hinge is affixed to a bottom edge of the rear portion and medially and horizontally of the outer surface of the rear wall, and the hinge includes a first main tubular body affixed to the rear wall, and a secondary tubular body affixed to the bottom edge of the rear portion, wherein the secondary tubular body includes an axially aligned and extending alignment rod of a length substantially equal to that of a length defined by the main tubular body wherein the alignment rod is selectively receivable within the main tubular body to enable removal of the lid member relative to the desk container when the alignment rod is removed relative to the main tubular body.

5. A mobile desk apparatus as set forth in claim 4 wherein the mast assembly includes an outer tube and an inner tube, the outer tube including a friction detent threadedly mounted through the outer tube orthogonally thereto for selective frictional engagement with an exterior surface of the inner tube to permit adjustable telescoping positioning of the inner tube relative to the outer tube.

6. A mobile desk apparatus as set forth in claim 5 wherein the inner tube is axially aligned relative to a center of the floor 20, and the floor 20 includes a plurality of spaced "L" brackets positioned on diametrically opposed sides of the inner tube, and each "L" bracket includes an arcuate slot therethrough, and further including a threaded securement member directed through each of the arcuate slots and diametrically through the inner tube including a threaded securement member securable to a rear terminal end of the threaded securement member to secure the "L" brackets relative to the inner tube and adjustably permit the desk container to be pivotally oriented relative to the inner tube.

7. A mobile desk apparatus as set forth in claim 6 wherein the top planar portion of the lid member includes a handle integrally secured to an outer surface of the top planar portion adjacent a forward edge thereof.

8. A mobile desk apparatus as set forth in claim 7 further including a cylindrical peg member integrally and orthogonally mounted adjacent forward corners of the top planar portion and mounted to a bottom surface of the top planar portion, and receivable within respective alignment tubes integrally secured to interior surfaces of the desk container at intersections of the side and forward wall of the desk container, and wherein each of the alignment tubes defines an alignment tube diameter substantially equal to that of a peg diameter defined by each of the alignment pegs.

* * * * *